United States Patent [19]

Couchoud

[11] 3,963,790

[45] June 15, 1976

[54] NON-INFLAMMABLE FILAMENTS COMPRISING ACRYLONITRILE/VINYLIDENE CHLORIDE COPOLYMERS

[75] Inventor: Paul Couchoud, Dardilly, France

[73] Assignee: Rhone-Poulenc-Textile, Paris, France

[22] Filed: Sept. 3, 1974

[21] Appl. No.: 502,833

Related U.S. Application Data

[62] Division of Ser. No. 377,199, July 9, 1973, abandoned.

[30] Foreign Application Priority Data

Aug. 9, 1972 France ..... 72.29009

[52] U.S. Cl. ..... 260/898; 260/DIG. 24; 264/182; 260/DIG. 32

[51] Int. Cl.[2] ..... C08L 33/20

[58] Field of Search ..... 260/898, 377, 199, DIG. 24

[56] References Cited

UNITED STATES PATENTS

| | | | |
|---|---|---|---|
| 2,763,631 | 9/1956 | Coover et al. | 260/898 X |
| 2,769,792 | 11/1956 | Ham | 260/32.6 |
| 2,949,437 | 8/1960 | Hobson | 260/898 X |
| 3,288,888 | 11/1966 | Wieckowski | 260/898 |

*Primary Examiner*—Carman J. Seccuro
*Attorney, Agent, or Firm*—Cushman, Darby & Cushman

[57] ABSTRACT

Non-inflammable filaments having good physical characteristics are disclosed, wherein the filaments have a chlorine content of 25–40% by weight and a sticking temperature of at least 215°C, and a shrinkage of less than 32% when subjected to steam at 130°C in the free or unrestrained state. The filaments are formed by spinning a mixture of incompatible polymers, one polymer, used in an amount of 50–99% by weight, containing 79.5 to 58 weight percent of acrylonitrile units, 20–40 weight percent of vinylidene chloride units and 0.5 to 2 weight percent of a comonomer which enhances dyeability, and the other copolymer, used in an amount of from 1–50 weight percent, containing from 20–50 percent by weight of acrylonitrile units and 50–80 percent of vinylidene chloride units.

The filaments may be used in textile applications, such as for clothing, furniture upholstery, and the like.

7 Claims, 2 Drawing Figures

NON-INFLAMMABLE FILAMENTS COMPRISING ACRYLONITRILE/VINYLIDENE CHLORIDE COPOLYMERS

This is a division of application Ser. No. 377,199, filed July 9, 1973, now abandoned.

BACKGROUND OF THE INVENTION

The present invention relates to non-inflammable filaments, such as textile filaments, formed of two polymers, each containing acrylonitrile units and vinylidene chloride units. These filaments have a high chlorine content and exhibit low thermoplasticity.

Fibers based upon acrylonitrile polymers are in widespread use, particularly in the textile field, because of their excellent physical properties. However, these fibers have the distinct disadvantage that they ignite rather easily.

Synthetic fibers based upon chlorinated monomers, or predominantly based upon chlorinated monomers, are also known to the art, generally under the name "chlorofibers". Such fibers may contain up to 70% chlorine or so in practice. The chlorofibers are flame resistant but exhibit thermoplastic properties. That is, the fibers have a low sticking temperature and also exhibit high shrinkage at elevated temperatures, such as upon exposure to boiling water or steam. Because of the thermoplastic nature of these fibers, they have little use in textile applications.

The Wieckowski U.S. Pat. No. 3,288,888, issued Nov. 29, 1966, discloses the production of flame resistant acrylonitrile-vinylidene chloride polymer blend filaments by blending two different polymer components. One of the components is a polymer which contains acrylonitrile units but no vinylidene chloride units. Comonomers such as acrylic acid and methacrylic acid are used in amounts of up to 30%. The other polymeric component of the blend is a copolymer of acrylonitrile and vinylidene chloride, containing 30 to 70% vinylidene chloride. The two polymer components may be used in ratios of 2 to 98 parts of either component. The polymer components are completely compatible with one another, so that the resulting mixture can be spun into textile filaments. Because of this, the chlorine content of the polymer mixture generally is at a level of between 5 and 10%. However, such low chlorine contents are not high enough to impart the desired non-inflammable characteristics to the fibers. In this regard, the accepted criteria of non-inflammability of textile fibers is becoming stricter and stricter, and it is now generally recognized that the chlorine content of the fibers should be at least 25%, preferably at least 29%, by weight.

French Pat. No. 1,393,117 (corresponding to the above Wieckowski U.S. Pat. No. is slightly broader in proportions therein, indicating that the acrylonitrilevinylidene copolymer can contain less than 80% of vinylidene chloride and at least 20% acrylonitrile. The broadest disclosure of chlorine content in this French patent is about 4 to 20%.

French Pat. No., 1,211,700 is directed to spinable compositions of a mixture of polymers. One polymer, used in the amount of 95–70%, contains more than 80% of acrylonitrile units and less than 20% of a comonomer, while the second, halogenated polymer, used in an amount of 5–30%, contains more than 80% of vinyl chloride and/or vinylidene chloride units and less than 20% of a comonomer therewith. Polymers of this patent have a chlorine content of about 5 to 20%. However, the properties of fibers made from the polymer mixture of this patent are below the desired levels.

DESCRIPTION OF THE INVENTION

The present invention is directed to non-inflammable filaments which obviate the deficiencies of the prior art filaments, as described above. The filaments of the present invention have good physical and mechanical properties, and a chlorine content of 25–40% by weight. The filaments of the present invention have low thermoplasticity, with a sticking temperature above 215°C and a shrinkage, during treatment in the unrestrained condition with exposure to steam at 130°C, of less than 32%. At least 50 weight percent of the filament is a copolymer of about 79.5 to about 58 weight percent of acrylonitrile, 20–40 weight percent vinylidene chloride and 0.5 to 2 weight percent of a comonomer which enhances dyeability and 1–50 weight percent of the filament is a second copolymer of 20–50 weight percent of acrylonitrile and 50–80 weight percent of vinylidene chloride.

When used herein, the term "non-inflammable" is intended to refer to the characteristic of non-inflammability as determined on yarns and filaments by the test entitled "Au Portique", ordered by a decree of the French Ministry of Interior, dated Dec. 9, 1957, and published in the Official Journal of the French Republic of Jan. 16, 1958, page 611. The test consists of firing a vertical test tube with two cubic centimeters of burning alcohol, with the samples arranged in the test tube. The amount of destroyed surfaces are measured, and the samples rated, according to the following designations:

- less than 60 cm2, the sample is: "non-inflammable"
- from 60 to 100 cm2, the sample is: "not easily inflammable"
- from 100 to 200 cm2, the sample is: "of average inflammability"
- more than 200 cm2, the sample is: "easily inflammable"

The filaments of the present invention are formed of a mixture of:

A. 50–99% by weight of a copolymer of acrylonitrile, vinylidene chloride, and one or more comonomers which enhance dyeability (hereinafter called copolymer A). The weight proportions of the components of copolymer A are preferably from 79.5 to 58% of acrylonitrile, from 40–20% of vinylidene chloride, and from 2–0.5% of the comonomer enhancing dyeability.

B. 1–50% by weight of a copolymer of acrylonitrile and vinylidene chloride (hereinafter called copolymer B). Copolymer B suitably contains from 50–20 weight percent of acrylonitrie, and from 80–50 weight percent of vinylidene chloride.

In a particularly preferred embodiment, the filaments of the present invention have a chlorine content of 29–36% by weight, and are based upon a mixture of 65–75% by weight of copolymer A, the copolymer of acrylonitrile, vinylidene chloride and the comonomer enhancing dyeability, and 25–35% by weight of copolymer B, the copolymer of acrylonitrile and vinylidene chloride.

The filaments of the present invention, which have a high chlorine content, are obtained from two incompatible polymers which are immiscible when in a common solvent. that is, a mixture of the polymers, when dissolved in a common solvent, produces two distinct phases. These two phases are distinguishable after a mixing or blending operation. The solution of copolymer B appears to form a discontinuous phase or droplets, in the solution of copolymer B. Contrary to the teachings of the prior art, however, it has unexpectedly been found that highly acceptable textile filaments can be produced by spinning such a solution of two incompatible polymers; provided, however, that the size of particles or droplets in the mixture have an average particle size less than about 3 microns, preferably between 1–3 microns. While the average particle size should be less than 3 microns, it will be appreciated that a few individual particles may be larger than about 3 microns. However, such larger particles adversely affect the properties of the resulting fibers, and should be avoided.

A number of different comonomers may be used in copolymer A to enhance dyeability of the filament. Generally the comonomer will contain a vinyl-type unsaturated moiety and an acid group or a derivative of an acid group, such as salts, e.g., sodium salts. Preferably the comonomer is of the formula

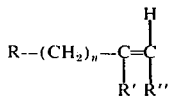

wherein R′ is a hydrogen, alkyl of 1–6 carbon atoms, or —COOH or salt thereof; R″ is hydrogen, or aryl or alkaryl of 6–14 carbon atoms, and R is —COOH or salt thereof or oxyarylsulfonate, oxyalkaryl sulfonate, arylsulfonate or alkylsulfonate, alkylarylsulfonate of 6–14 carbon atoms, and n is 0 to 6. Preferably the conomoner is an vinyl-unsaturated aliphatic carboxylic acid of 3–12 carbon atoms, such as, for instance, acrylic acid, methacrylic acid, itaconic acid, or a vinyl-unsaturated aromatic sulfonate compound of 8–16 carbon atoms, such as styrene sulfonate, vinyl oxybenzene sulfonate, and vinyl oxynaphthalene sulfonate, or vinyl-unsaturated aliphatic sulfonate compounds of 2 to 12 carbon atoms, such as allyl sulfonate and methallyl sulfonate. Other suitable comonomers include methallyloxybenzene sulfonate, allyloxybenzene sulfonate, sodium paramethacrylamidobenzene sulfonate and cinnamic acid.

As mentioned, the two copolymers are incompatible, and when dissolved in a common solvent to form a spinning solution, the spinning solution is not homogeneous. That is, two polymer phases can be distinguished, either visually or by conventional experimental means. The polymers form different phases in the spinning solution, as well as in the fiber itself. One phase (that of the copolymers) is in the form of dispersed droplets, which must be of such fineness that the system is stable for several days without agitation. This condition is met, and the mixtures of polymers may be spun, when the average particle size of the particles or droplets is lower than or equal to 3 microns. The average particle size surprisingly is characteristic of the precise composition of the two copolymers and of their relative proportions in the mixture. If the chlorine content of the mixture is increased, the particle sizes will become too large, with undue phase separation then found on the fibers themselves, and the resulting fibers exhibit non-homogeneous characteristics which are unacceptable for textile uses. Furthermore, if the particle size is increased significantly above the upper limit of three microns, the polymer mixture is no longer spinnable.

In addition to the fact that it is possible to obtain, by spinning, filaments starting from spinning solutions of polymer mixtures exhibiting imcompatibility such that dispersed droplets up to three microns in size are present in the spinning solution, it is also surprising that it is possible to obtain textile fibers having chlorine contents between 25–40 percent which exhibit low thermoplasticity characteristics.

As mentioned hereinabove, it is known that the chlorofibers exhibit a low sticking temperature, depending upon the chlorine content of the fibers, with the sticking temperature decreasing very rapidly when the chlorine content is increased. In contrast, the fibers of the present invention have a high sticking temperature, generally between 215° and 235°C, and a yellowing point which is not significantly lower than that of fibers obtained from copolymer A alone, and this yellowing point remains substantially constant for chlorine contents within the range of 25–40 weight percent.

Another disadvantage of prior art fibers having a high chlorine content is their high shrinkage in boiling water, in steam, or even in heated dry air. Surprisingly, the present fibers, having chlorine contents of between 25–40 weight percent, have shrinkages which are less than chlorofibers having the same chlorine contents, with the shrinkage in the free state being between about 25 and about 32 percent in steam at 130°C.

The fibers produced by the process of the present invention also exhibit excellent dyeing affinity in spite of their high chlorine contents. This is surprising, as it is well known that an increase in the chlorine content, such as increasing the proportion of chlorinated monomers, e.g., vinylidene chloride or vinyl chloride, for instance, results in a lowering of the dyeing affinity of the resulting fibers, and this is true even for the same contents of dyestuff-reactive sites.

The filaments of the present invention are obtained by spinning a spinning solution, containing the copolymer mixture, by any known spinning method. Generally, the polymer mixtures are first dissolved in conventional, inert, polar organic solvents, such as dimethylformamide, dimethylacetamide, dimethylsulfoxide, and N-methyl-pyrrolidone. Additional suitable solvents are disclosed in U.S. Pat. No. 3,288,888, the disclosure of which is hereby incorporated by reference. In certain instances, it is advantageous for the solvent to contain a small amount of water, which can be as much as up to 20% by weight, in relation to the weight of the polymer mixture. Generally, water is used in an amount of from 0 to about 20% by weight, preferably from 5–20%, based on the weight of the polymer mixture. The concentration of the polymer mixture in the spinning solution may vary, depending upon the viscosity and other factors, but normally the spinning solution will contain about 18–25% by weight of the polymer mixture. In order for the spinning solution to be readily spun, the viscosity of the spinning solution will generally be from 150 to 1000 poises. As mentioned previously, the spinning solution is non-homogeneous, and contains droplets having an average particle size of 1–3 microns.

The spinning solution may be spun by any of the conventional processes known to those in the art, but it is preferably spun using the known wet process. That is, the spun filaments are coagulated in a mixture of water and polymer solvent, in respective proportions of 60/40–30/70, for instance. the coagulating bath is normally maintained at a temperature of from 0°–20°C or even higher.

After coagulation, the filaments can then be optionally subjected to a prestretching operation in air at a low stretching rate, for example, in the order of 1–2X, in order to produce a low molecular orientation. The filaments are then suitably washed, generally in a water wash, preferably counter-currently, according to procedures known to those in the art, for instance, by passage on rollers. The washed filaments are then generally subjected to a stretching treatment at a rate of between 2–4X, generally at elevated temperatures, for instance, in boiling water or steam, according to methods known to those in the art, for instance, through tubes, on a heating plate, or in a water bath. Normally, the stretching temperature will be in a range of about 90° to about 130°C. The filaments may then be dried using conventional techniques, for instance, in a housing or on appropriate rollers at temperatures of, e.g., 70°C to 150°C, or even higher. Optionally, the filaments may be treated, under tension or in the absence of tension, at temperatures from 105°C to 130°C or even higher, either during the drying or later, in order to stabilize or crimp them, for example, eventually in presence of steam, as known to those in the art.

The resulting filaments are useable as such or may be cut into short fibers and used alone or mixed with other types of fibers to produce textile articles such as knits, woven fabrics, non-woven fabrics, shaggy textile articles, and the like. The filaments thus obtained are highly useful in most textile applications, particularly for garments and furniture upholstery, as well as for industrial uses, because of their non-inflammability and their overall good textile properties.

The copolymers A and B may be produced by normal polymerization techniques. For instance, the polymerization process described in journal of Polymer Science Vol. 57 — pages 855–866 (1962).

Generally, the copolymer A has a specific viscosity of about 0.3 to 0.4 and the copolymer B has a specific viscosity of about 0.1 to 0.3, preferably of about 0.15 to 0.25.

DESCRIPTION OF THE DRAWINGS

The invention will be more clearly understood with reference to the accompanying drawings, wherein.

The curves of the drawings illustrate the low thermoplasticity of the filaments of the present invention. The filaments which were compared were based on Example 1A and Comparative Example 1B, described hereinbelow, with the chlorine content of the resulting filaments varied. That is, the control copolymers were copolymers of acrylonitrile, vinylidene chloride and 1.3 weight percent of potassium vinyloxybenzene sulfonate, with the chlorine content varied from about 25 to about 40%. The filaments of the curves which represent the present invention were produced from a mixture of a copolymer A, containing 69.3 weight percent of acrylonitrile units, 29.4 weight percent of vinylidene chloride units and 1.3 weight percent of potassium vinyloxybenzene sulfonate units, and a copolymer B, containing 22 weight percent of acrylonitrile units and 78 weight percent of vinylidene chloride units. The proportion of copolymer A to copolymer B was varied to vary the chlorine content from 25–40%.

Figure 1:
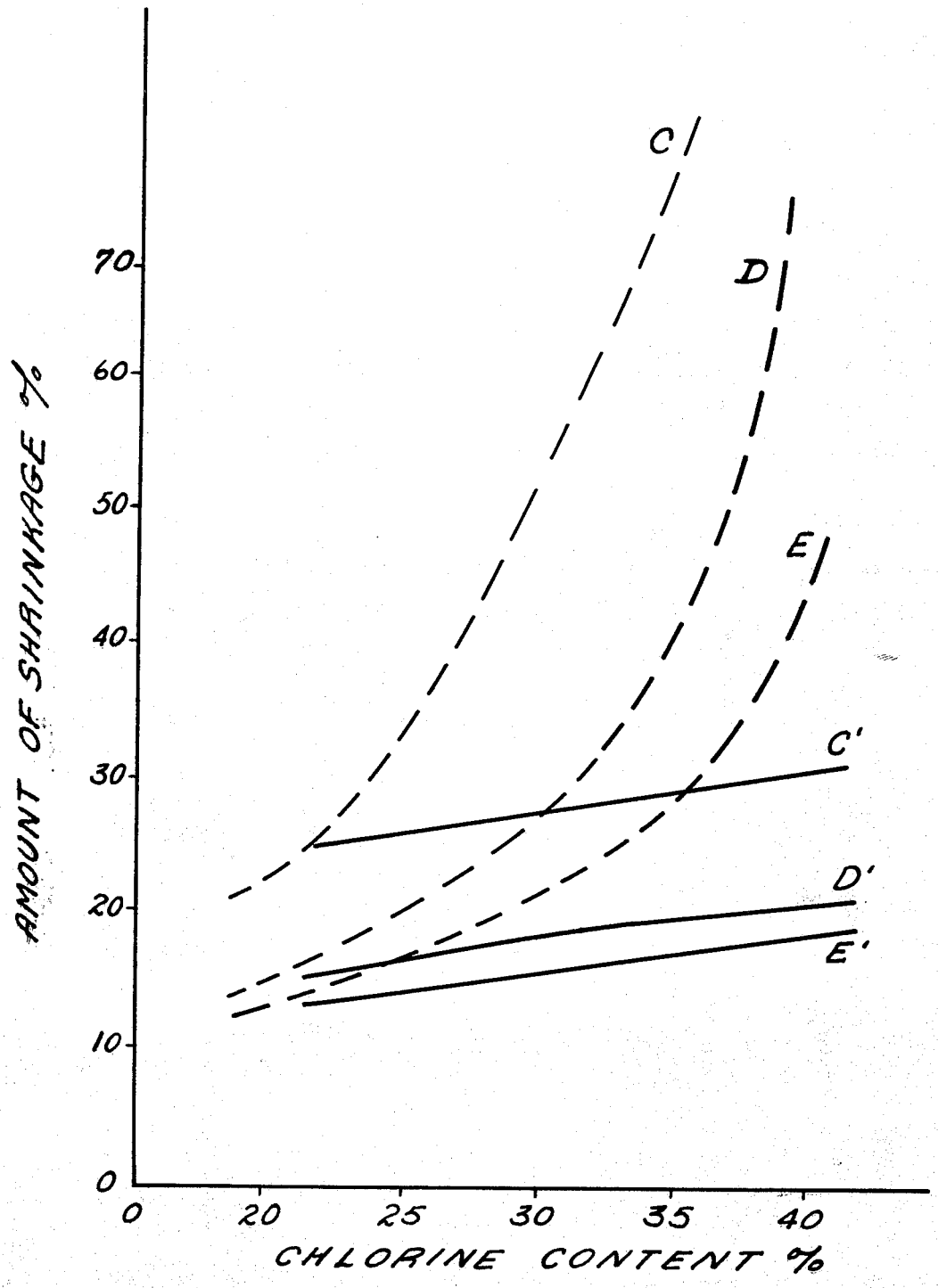
FIG. 1 is a set of curves representing the change in the amount of shrinkage of filaments plotted against the chlorine contents of the filaments.

In FIG. 1, curve C represents the control filament and curve C′ represents the filament of the present invention, when subjected to shrinkage by thermal treatment at 130°C in the presence of steam, with variation of the chlorine contents of the filaments. Curve D represents the control filament and curve D′ represents the filament of the present invention, illustrating variations in shrinkage in dry air at 180°C, against the chlorine contents of the filaments. Curve E represents the control filaments and curve E′ represents the filament of the present invention, illustrating shrinkage rates of the filaments in boiling water against the filament chlorine content.

Figure 2:
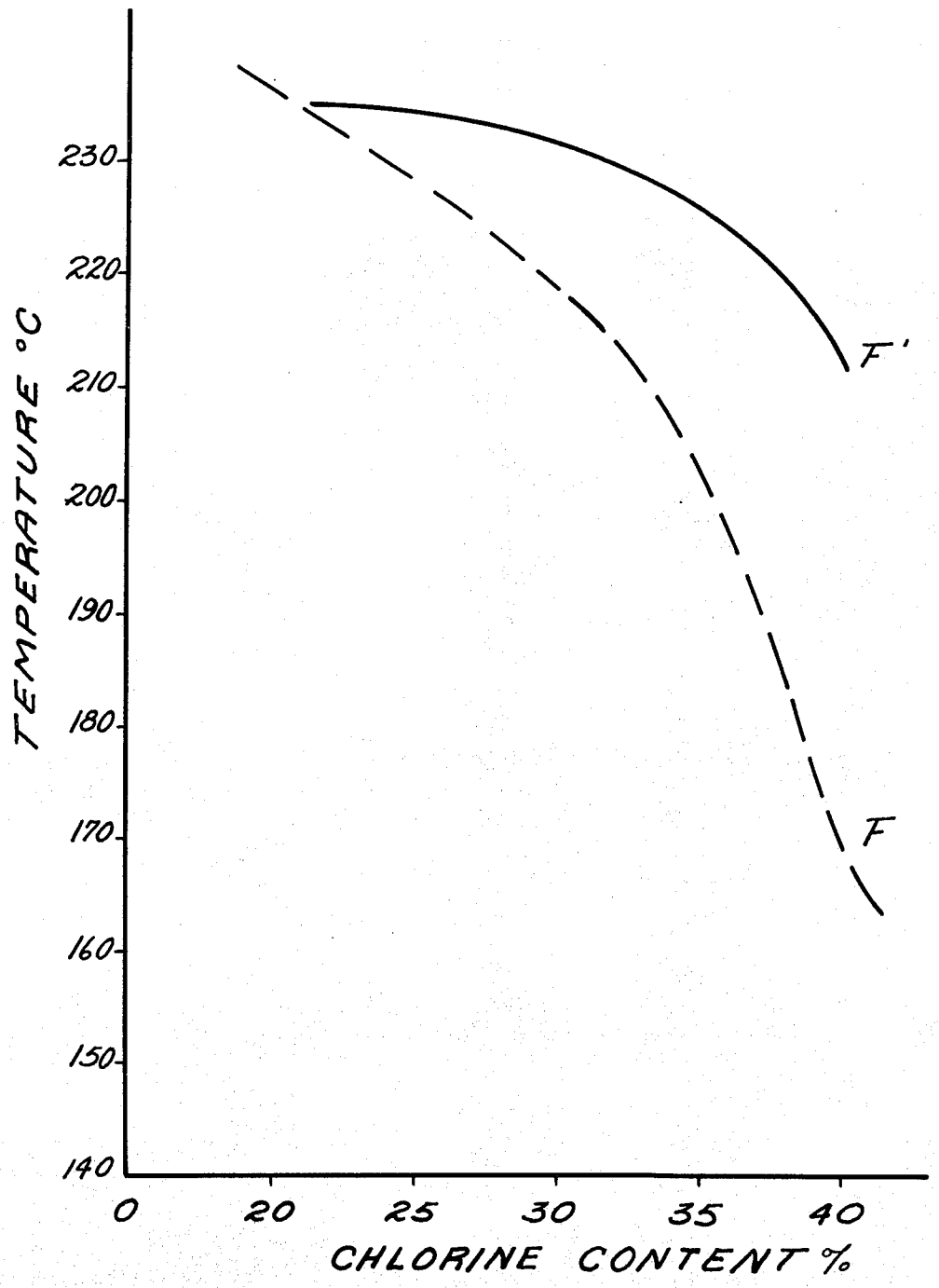
FIG. 2 is another set of curves illustrating the change of sticking temperature, in degrees C, with the chlorine contents of the filaments.

In FIG. 2, curve F represents the control filaments and curve F′ represents the filaments of the present invention, illustrating the variation of the sticking temperature in relation to the chlorine content of the filaments.

It will be readily appreciated that the filaments of the present invention exhibit significantly lower thermoplasticity characteristics than do the control filaments for equal chlorine contents, of between 25–40 weight percent of chlorine.

EXAMPLES OF THE INVENTION

The invention will be more clearly understood with reference to the following examples, which are intended to illustrate but not limit the invention.

EXAMPLE 1A

In this example, two polymers were mixed, a copolymer A and a copolymer B. Copolymer A contained 69.3 weight % acrylonitrile units, 29.4 weight % vinylidene chloride units, and 1.3 weight % of potassium vinyloxybenzene sulfonate units. Copolymer B, which had a specific viscosity $\eta$ sp of 0.21, contained 22 weight % of acrylonitrile units and 78 weight % of vinylidene chloride units.

The two copolymers, in a molar ratio of 75/25 of copolymer A/copolymer B, were dissolved in dimethyl formamide, containing 20% by weight of water, relatively to the weight of the polymers. The concentration of the polymers in the solution was 21.9%, and the solution viscosity was 230 poises. The droplets dispersed in the solution had an average particle size of 2 microns. The chlorine content of the mixed polymers was 30.7%.

The resulting spinning solution was extruded through a spinneret having 64 orifices, each of 7/100 mm in diameter, into a bath of dimethyl formamide and water, in a weight ratio of 40/60, respectively, maintained at 5°C. The filaments were coagulated in the bath and then subjected to a prestretching in air (at a rate of 1.6X), then counter-currently washed in water at ambient temperature, and thereafter stretched in boiling water (at a rate of 3.8X). The filaments were then dried at 70°C on heating rollers.

The results of the physical testing of the filaments are set forth in Table I below. In Table I, the percent shrinkage is reported for unrestrained filaments in boiling water, in saturated steam at 130°C, and in air at 180°C. The sticking temperature and the yellowing point were determined in a device having several plugs heated at different temperatures, available commercially under the designation "Thermotest", distributed by S.E.T.A.R.A.M. The "Thermotest" enables to study the behaviour of fabrics when subjected to various temperatures. the results obtained are identical to those produced by ironing. It comprises 13 keys the temperture of which is variable to 300°C, each key corresponding to a different temperature. The pressure on the sample is variable from 30 to 70 g/cm².

COMPARATIVE EXAMPLE IB

Example 1A was repeated, except that a polymer mixture was not used, and instead a copolymer containing 30.7% by weight chlorine was used in place of the polymer mixture. This copolymer contained 55.5 weight % of acrylonitrile units, 43.2 weight % of vinylidene chloride units, and 1.3 weight % of potassium vinyloxybenzene sulfonate.

The physical properties of the filaments are reported in Table I below.

COMPARATIVE EXAMPLE 1C

Example 1A was repreated, except that copolymer B was replaced with a corresponding amount of copolymer A; that is, the spinning solution contained only copolymer A, having a chlorine content of 21.3%. The results of the physical testing of the filaments are set forth in Table 1 below.

The filaments of Example 1A and Comparative Example 1C exhibited good dyeability, while the filament of Comparative Example 1B was clearly inferior in dyeability.

EXAMPLE 2A, COMPARATIVE EXAMPLE 2B AND COMPARATIVE EXAMPLE 2C

Examples 1A, 1B and 1C were repeated, except the solvent was replaced by N-methylpyrrolidone, containing 8% by weight of water, in relation to the weight of the polymer. The filaments were spun into a bath containing N-methylpyrrolidone and water, in a proportion of 40/60, respectively, and maintained at 25°C. The spinning solution concentration was 19.2%, and the solution had a viscosity of 400 poises.

The results obtained for each example are identical to those of the Examples 1A, 1B and 1C, respectively.

EXAMPLE 3A

This example relates to the use of a mixture of copolymers. Copolymer A is the same as copolymer A of Example 1A, and copolymer B, which had a specific viscosity $\eta$ sp of 0.30, contained 37 weight percent of acrylonitrile units and 63 weight percent of vinylidene chloride units. The polymers were used in a ratio of copolymer A/copolymer B of 75/25, with the mixture containing 28.1% by weight of chlorine. The two polymers were dissolved in dimethylsulfoxide and at a polymer concentration of 19% by weight. The size of the copolymer B droplets in the solution was of the order of 2 microns.

The spinning solution was spun into a coagulating bath containing dimethylsulfoxide and water in proportions of 40/60, respectively, and maintained at a temperature of 25°C. Thereafter, the fibers were treated the same as in Example 1.

Homogeneous filaments having good dyeability were obtained. The mechanical properties of these filaments are reported in Table 1 below.

COMPARATIVE EXAMPLE 3B

Example 3A was repeated, except the spinning solution contained 25% by weight of copolymer A, and no copolymer B.

The characteristics of the resulting fibers are also reported in Table 1 below.

EXAMPLE 4A

This example relates to the use of two copolymers, the copolymers A and B of Example 1A. The copolymers were used in a weight proportion of 50/50, producing a polymer mixture having a chlorine content of 39.5% by weight.

The procedure of Example 1 was used to obtain a spinning solution having an average droplet size of about 3 microns. The spinning solution was spun into filaments according to the procedure of Example 1.

COMPARATIVE EXAMPLE 4B

This example involves the spinning of a single copolymer. The copolymer, containing 39 weight percent of chlorine, was based upon 48.5 weight percent of acrylonitrile units, 50.5 weight percent of vinylidene chloride units, and 1 weight percent of sodium methallyl sulfonate units.

The copolymer was dissolved to form a spinning solution and spun in the same manner as Example 4A.

The properties of the fibers obtained in Example 4A and Comparative Example 4B are reported in Table 1 below.

EXAMPLE 5

Example 1A was repeated, but copolymers A and B were used in proportions of 70/30, respectively, with the copolymer mixture containing 32.4% by weight of chlorine. The polymers were dissolved to form a spinning solution according to the procedure of Example 1A, with the droplet average particle size in the spinning solution being about 2 $\mu$.

The filaments were spun following the procedure of Example 1A.

COMPARATIVE EXAMPLE 5B

A copolymer, containing 33 percent by weight of chlorine, and containing 45.1 weight percent of vinylidene chloride units, 53.9 weight percent of acrylonitrile units, and one weight percent sodium methallyl sulfonate units, was used in this comparative example. The copolymer was dissolved and spun following the procedure, and using the same solvent, as comparative Example 1B.

The characteristics of the filaments obtained in Example 5A and Comparative Example 5B are reported in Table 1 below.

TABLE I

| Example | Sticking Temperature, °C | Yellowing Point, °C | Percent shrinkage In boiling water | In steam at 130°C | In air at 180°C | Tenacity g/tex | Elongation % | Modulus of elasticity g/tex | Au Poutique test |
|---|---|---|---|---|---|---|---|---|---|
| 1 a | 230 | 145°C | 16 | 28 | 18 | 26 | 17 | 515 | non inflammable |
| 1 b | 215 | 155°C | 22 | 58 | 22 | 26 | 13 | 780 | non inflammable |
| 1 c | 235 | 155°C | 14 | 24 | 16 | 26 | 15 | 760 | of average flammability |
| 3 a | 232 | 150 | 14 | 22 | | 24 | 8,5 | | not easily inflammable |
| 3 b | 235 | 155 | 14 | 19 | | 28 | 6 | | of average flammability |
| 4 a | 215 | 145 | 19,5 | 31 | 20 | 24 | 19 | 425 | non inflammable |
| 4 b | 178 | 155 | 39 | ∞ | 70 | 25 | 13 | 450 | non inflammable |
| 5 a | 230 | | 16,5 | 28 | 18 | 26 | 16 | 720 | non inflammable |
| 5 b | 215 | | 22 | 68 | 26,5 | 31 | 14 | 500 | non inflammable |

What is claimed is:

1. Non-inflammable filaments of at least two incompatible copolymers of acrylonitrile and vinylidene chloride, said filaments having:

a. a sticking temperature of at least 215°C., b. a shrinkage of less than 32% when subjected to steam at 130°C. in the unrestrained state, c. two distinct phases, a continuous phase and a dispersed phase, the average size of the dispersed phase particles being less than 3 microns, d. the following composition:

i. at least about 50 weight percent of the filament being a copolymer of about 79.5 to about 58 weight percent of acrylonitrile, 20 to about 40 weight percent of vinylidene chloride, and about 0.5 to about 2 weight percent of a comonomer which enhances dyeability, and ii. less than about 50 weight percent of a second copolymer of about 20 to about 50 weight percent of acrylonitrile and about 50 to about 80 weight percent of vinylidene chloride, e. and a chlorine content of 25 to about 40% by weight.

2. Filaments according to claim 1, wherein said filaments are based on a mixture of about 65 to about 75 percent by weight of said copolymer, and about 25 to about 35% by weight of said second copolymer.

3. Filaments according to claim 1, wherein the filaments have a sticking temperature of 215°C to 235°C.

4. Filaments according to claim 1, wherein the filaments have a shrinkage when treated with steam at 130°C in the free state of between 25 and 32%.

5. Filaments according to claim 1, wherein the filaments have a chlorine content of 29–36% by weight.

6. Filaments according to claim 1, wherein the filaments are obtained by spinning an incompatible mixture of the copolymer and the second copolymer in a common inert polar organic solvent, wherein the solution of the second copolymer forms a dispersed phase in the solution of the said copolymer, said dispersed phase having an average particle size, or droplet size, of 1–3 microns.

7. Filaments according to claim 1, wherein the said copolymer and said second copolymer are incompatible to the extent that when dissolved in a common solvent at a concentration of 18–25 weight percent, the solution of said second copolymer forms droplets having average particle sizes of about 1 – about 3 microns in the solution of said copolymer.

* * * * *